US005931561A

United States Patent [19]

Broderick

[11] Patent Number: 5,931,561

[45] Date of Patent: Aug. 3, 1999

[54] ASYMMETRIC LIGHTING DISPLAY

[76] Inventor: Thomas F. Broderick, 19564 44th Ave. NE., Lake Forest Park, Wash. 98155

[21] Appl. No.: 08/773,680

[22] Filed: Dec. 24, 1996

[51] Int. Cl.[6] ..... F21P 1/02

[52] U.S. Cl. ..... 362/145; 362/252; 362/806

[58] Field of Search ..... 362/145, 152, 362/234, 249, 252, 391, 806, 808

[56] References Cited

U.S. PATENT DOCUMENTS

| | | | |
|---|---|---|---|
| 3,189,310 | 6/1965 | Trueson | 362/249 |
| 3,540,687 | 11/1970 | Cuva | 362/249 |
| 4,128,863 | 12/1978 | Premetz | 362/249 |
| 5,297,012 | 3/1994 | Fletcher | 362/252 |
| 5,404,279 | 4/1995 | Wood | 362/145 |
| 5,669,707 | 9/1997 | Huang | 362/249 |
| 5,685,635 | 11/1997 | Barthelmess | 362/249 |

*Primary Examiner*—Alan Cariaso
*Attorney, Agent, or Firm*—Thomas F. Broderick

[57] ABSTRACT

A method of attaching a string of decorative lights to the outline of a house, by attaching a string of decorative lights to outline both a first side of the house in a first regular parallelogram array and a second adjacent side of the house in a second regular parallelogram array, wherein the first and second parallelograms slant in opposite directions. When lit, the resulting light display is slightly out of register with the outline of the house. This subtle asymmetry fools the passing eye into taking a second look.

1 Claim, 1 Drawing Sheet

ASYMMETRIC LIGHTING DISPLAY

BACKGROUND OF THE INVENTION

FIG. 1 shows a conventional decorative light display 10 attached to the outline of a house 12. A string 14 of decorative lights 16 is attached to the corners 18,20,22,24 of at least three adjoining edges 26,28,30 of a side 32 of the house 12. Such holiday lighting displays have become so common in suburbs as to pass virtually unnoticed. To attract attention, many homeowners add additional lights and lighted displays. This practice raises energy conservation and often aesthetic concerns.

SUMMARY OF THE INVENTION

My invention provides a simple, eye-catching way of attaching decorative lights to the outline of a house. Instead of attaching a string of lights directly to each corner of the house, the string is attached at every other corner to a short member that extends distally from the house in a common plane within the angle complementary to each corner. This configuration causes the lighted display to depart subtly from the typically regular rhomboid shape of the house. The resulting trompe l'oeil effect is achieved using short members, on the order of six inches per vertical story, that are preferably disposed parallel to the vertical roof line of the house. A festive and energy conservative holiday lighting display results.

DETAILED DESCRIPTION OF THE PREFERRED EMBODIMENT

Figure 1:
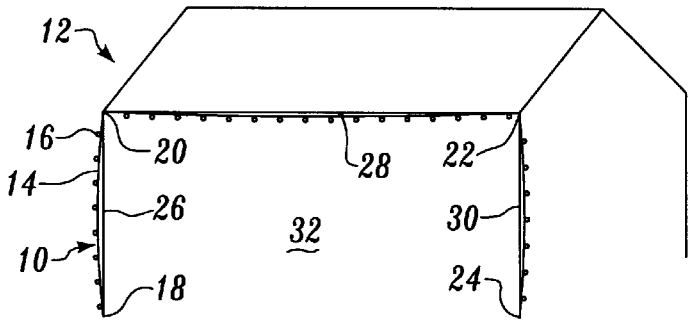
(PRIOR ART) Fig. 1
FIG. 1 shows a conventional lighting display.
Figure 2:
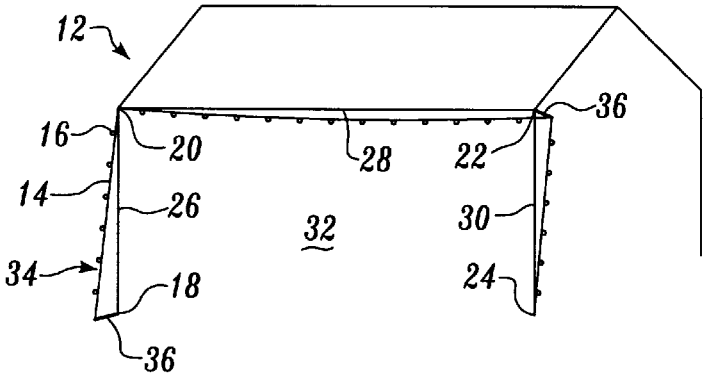
FIG. 2 shows an asymmetric lighting display of the invention, attached to one side of a house.

FIG. 2 shows a representative embodiment of my asymmetric lighting display 34. Here a string 14 of lights 16 is attached directly to alternating corners 20,24, and indirectly to the other corners 18,22 by members 36 that extend out a short distance from the house 12. When lit, the resulting light display 34 is slightly out of register with the outline of the house 12. This subtle asymmetry fools the passing eye into taking a second look.

The goal of this invention is thus to shift the expected regular rhomboid outline just enough to entice the viewer to unconsciously take another look, without evoking a perception that the house is leaning or toppling. This desired visual effect is achieved by empirically adjusting three characteristics of the light-hanging members 36.

First, the length of the member 36, and hence the distance that the light cord 14 is held away from the house 12, is the most important variable. In practice, a short distance of around four to eight inches per vertical story is recommended, with about six inches being preferred. In this regard it should be noted that the members 36 shown in FIG. 2 are drawn at greatly exaggerated scale for illustrative effect.

Second, the members 36 should extend distally from the house in a common orientation with respect to their respective corners, that is, in a common plane within the angle complementary to each corner. Preferably each member extends distally from the house in a plane bisecting the angle complementary to its corner. By disposing the members in this manner, at an angle (135°) equidistant from adjacent sides of the house, the perceived three-dimensional asymmetry of the lighted display is enhanced as one drives or walks by the house.

Third, the members 36 are preferably disposed parallel to the horizontal roof line 28 of the house, as this orientation presents the lighted display 34 as a regular parallelogram. Other angles of orientation may be employed, such as 45° relative to the roof line, but this tends to push the lighted array into an irregular rhomboid shape that simply puzzles the eye.

The members 36 are conveniently constructed out of metal or wood using available materials. Commercially available sheet metal fixtures, such as end post caps (Model ACE4, Simpson Strong-Tie Co., Pleasanton, Calif.), can be reversibly screwed to alternating corners of the exterior of a house for this purpose. A wooden member 36 is attached to the available flange on this fixture, and the flange with attached member is bent to the desired angle of orientation. The light cord 14 is attached to the distal end of the member 36 with tape or twine.

Figure 3:
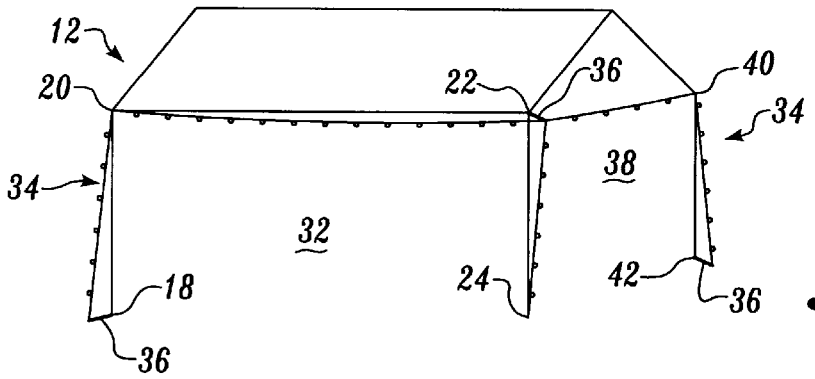
FIG. 3 shows an asymmetric lighting display attached to two adjoining sides of a house.

FIG. 3 shows a representative lighting display 34 of the invention attached to alternating corners on two sides 32,38 of a house 12. The eye-catching three-dimensional asymmetry is particularly enhanced in the illustrated configuration, as the perceived parallelogram defined by corners 18,20,22,24 is slanted in the opposite direction as the one defined by corners 24,22,40,42.

While the invention has been described in terms of a preferred embodiment, one of ordinary skill after reading the foregoing description will be able to effect various changes, substitutions of equivalents, and alterations to the subject matter described herein. For example, in addition to holiday use, the subject asymmetric lighting displays can serve advertising purposes on retail buildings throughout the year. It is therefore intended that the protection granted by Letters Patent hereon be limited only by the definitions contained in the appended claims and equivalents thereof.

I claim:

1. A method of attaching a string of decorative lights to an outline of a house, comprising attaching a string of decorative lights to outline both a first side of the house in a first regular parallelogram array and a second adjacent side of the house in a second regular parallelogram array, wherein the string of decorative lights in each of the first and second parallelogram arrays outlines at least three adjoining edges of the first or second side including an adjacent edge of the first and second sides, and wherein the first and second parallelogram arrays slant in opposite directions when viewed at an angle equidistant from the adjacent sides of the house.

* * * * *